US005725298A

United States Patent [19]

Kalze et al.

[11] Patent Number: 5,725,298

[45] Date of Patent: Mar. 10, 1998

[54] VEHICULAR HEADLIGHT PROVIDING HIGH-BEAM AND DEPRESSED-BEAM ILLUMINATION, AND LIGHT SOURCE THEREFOR

[75] Inventors: Franz-Josef Kalze, Harsewinkel; Wolfgang Peitz, Warstein; Rolf Kiesel, Aalen, all of Germany

[73] Assignees: Hella KG Hueck & Co., Lippstadt; Patent-Treuhand-Gesellschaft f. elektrische Gluehlampen mbH, Munich, both of Germany

[21] Appl. No.: 803,387

[22] Filed: Feb. 20, 1997

[30] Foreign Application Priority Data

Feb. 23, 1996 [DE] Germany ..... 196 06 876.2

[51] Int. Cl.[6] ..... F21M 3/14

[52] U.S. Cl. ..... 362/214; 362/61; 362/305; 362/346

[58] Field of Search ..... 362/61, 211, 214, 362/215, 297, 304, 305, 346

[56] References Cited

U.S. PATENT DOCUMENTS

| | | | |
|---|---|---|---|
| 3,493,806 | 2/1970 | Jacobs et al. . | |
| 3,569,693 | 3/1971 | Lindae et al. . | |
| 4,074,167 | 2/1978 | van den Broek et al. | 313/222 |
| 4,225,903 | 9/1980 | Buchleitner | 362/61 |
| 4,945,454 | 7/1990 | Bunse et al. | 362/61 |
| 5,089,942 | 2/1992 | Sekiguchi | 362/214 |
| 5,204,820 | 4/1993 | Strobel et al. | 364/468 |

FOREIGN PATENT DOCUMENTS

| | | |
|---|---|---|
| 0 703 403 A1 | 3/1996 | European Pat. Off. . |
| 0 709 619 A1 | 5/1996 | European Pat. Off. . |
| 1 539 371 | 12/1969 | Germany . |
| 27 20 956 | 11/1978 | Germany . |
| 41 24 374 A1 | 1/1993 | Germany . |
| WO 96/30696 | 10/1996 | WIPO . |

*Primary Examiner*—Stephen F. Husar

*Attorney, Agent, or Firm*—Frishauf, Holtz, Goodman, Langer & Chick, P.C.

[57] ABSTRACT

To provide for improved light distribution of a vehicular headlight furnishing both depressed-beam and high-beam illumination, a shadow cap (9, 25) partly surrounds a main light source, typically filaments of halogen incandescent lamp, located in a reflector (2) which has two segments (14, 15) of different contours. The first one (14) of the reflector segments is optically associated with the main filament furnishing depressed-beam illumination, and this segment has a free-formed surface reflection contour. A second segment of the reflector is optically associated with an auxiliary filament (8, 18). The shadow cap (9, 25) provides a shadow angle of between 100° and 140° with respect to light emitted from the main filament (7) to define a shadow zone (12) and a light zone (13) on the reflector. The shadow cap is shaped and positioned with respect to the auxiliary filament (8, 18) such that the auxiliary filament is located within the shadow zone (12). The auxiliary filament is located by an offset of between 0.25 and 2 times below the optical axis (A) of the reflector, and the spatial distribution of the segments is such that the reflector is associated with a light zone and a shadow zone, respectively, as formed by the shadow cap. For high-beam illumination, with only the auxiliary filament (8, 18) energized, a concentrated beam and somewhat spread illumination based on reflection from the first reflector segment (14) is obtained; when the main filament (7) is additionally energized, concentrated beam and defined spread-out illumination results.

20 Claims, 7 Drawing Sheets

VEHICULAR HEADLIGHT PROVIDING HIGH-BEAM AND DEPRESSED-BEAM ILLUMINATION, AND LIGHT SOURCE THEREFOR

Reference to related patents, the disclosures of which are hereby incorporated by reference:

U.S. Pat. No. 3,569,693, Lindae et al.

U.S. Pat. No. 3,493,806, Jacobs et al.

U.S. Pat. No. 4,074,167, van den Broek et al.

U.S. Pat. No. 4,945,454, Bunse et al.

U.S. Pat. No. 5,204,820, Strobel et al.

Reference to related published patents:

German 1 539 371, Kubitz

German 27 20 956, Buchleitner

German 41 24 374, Peitz

Int. Appl. WO 96/30696, Feger.

European Application 0 709 619, Fray

European Application 0 703 403, Zattoni.

FIELD OF THE INVENTION

The present invention relates to a vehicular headlight, and to a light source therefor, preferably a halogen incandescent lamp, in which the headlight can provide high-beam and low, or depressed-beam illumination, and in which two light emitting elements, typically filaments, are located in a bulb, one of the light emitting elements being shaded by a shadow generating element, such as a shadow cap.

BACKGROUND

Vehicular headlights typically have a light source or two light sources which are optically coupled to a free-form surface reflector, and include a metallic shadow generating element, hereinafter after referred to as a "shadow cap" or "shading cap", to define a light beam for depressed-beam service. Preferably, the light source is a halogen incandescent lamp.

Halogen incandescent lamps used in vehicular headlights, and having the standardized nomenclature H4 lamps, are described, for example, in U.S. Pat. No. 4,074,167, van den Broek et al. The lamp bulb retains a depressed-beam light generating element and a high-beam light generating element, both in axially aligned position. A shadow cap, referred to as a "dipping cap", so retains the depressed beam light emitting element that the cap forms almost a half-round cup, that is, has an azimuth of almost 180°. The shadow cap is radially extended at the base-side of the depressed-beam light emitting element, so that it shades the high-beam light emitting element.

The basic principle of such lamps is extensively described in the patent literature, see for example U.S. Pat. No. 3,569,693, Lindae et al, and German 1 539 371, Kubitz. The shadow cap is responsible for generating the brightness—darkness limit by projection of its lateral edges on the reflector. Preferably, the road ahead of the headlight is illuminated asymmetrically. This asymmetry is obtained by not entirely raising one side of the shadow cap up to the plane of the depressed beam light emitting element. Rather, it is terminated about 15° therebelow, so that the angle covered by the shadow cap will be only about 165°—see for example U.S. Pat. No. 3,493,806, Jacobs et al. The high-beam light emitting element, typically a filament, need not be axially aligned with the low-beam filament; in general, a transverse filament may also be used. In this mode of operation, in which normally only one of the filaments is energized to obtain either high-beam or low-beam illumination, the reflector is not efficiently utilized. The loss due to the shading by the shadow cap is in the order of about 40% of the entire angle, in space, in case the depressed beam is used. Conversely, for high-beam illumination, only about 40% of the angle, in space, can be used, whereas about 60% of the angle, in space, is utilized to illuminate the field close to the vehicle, since the light of the high beam is diffused by the portion of the reflector which is intended to be associated with the low beam.

The reflector usually is formed of two paraboloid portions, see for example German 27 20 956, Buchleitner. Free-form surface reflectors are also used at times, described for example in U.S. Pat. No. 4,945,454, Bunse et al., and U.S. Pat. No. 5,204,820, Strobel et al. Free-form surface reflectors are also described in International Publication WO 96/3096, Feger; and other automotive reflectors in European 0 709 619, Fray, and European 0 703 403, Zattoni.

The foregoing principles of illumination all are based on compromises of requirements which are individually contradictory; an optimal compromise has not yet been found.

THE INVENTION

It is an object to provide a vehicular headlight with a reflector and a light source, and a lamp for such a headlight, which is highly flexible in the design of the multiple function which the headlight is to provide; and, particularly, to provide an optimum solution for the two functions of depressed-beam and high-beam illumination, and to provide a general concept for modern light projection which can be variably designed and satisfy special requirements; and further to provide a lamp which is particularly suitable for a headlight, that is, in a lamp—reflector combination which meets the foregoing requirements.

Briefly, the lamp has a bulb with two light emitting elements, typically filaments; the bulb retains the usual halogen-inert gas fill. For simplicity, the light emitting elements will be referred to hereinafter merely as "filaments". The filaments form a main light source which is axially located within the bulb, and a second or auxiliary light source. A shadow cap is located within the bulb. The bulb, preferably, is located within a reflector which has two segments, the reflector defining an optical axis.

In accordance with the invention, the segments of the reflector have two different contours, at least one of the contours of a first one of the segments having a free-form surface contour. This first one of the segments is optically associated with the main filament. The second one of the segments of the reflector is optically associated with the auxiliary filament. The shadow cap has a shadow angle of between 100° and 140° with respect to light emitted from the main light source, to form a shadow zone and a light zone within the reflector. The shadow cap is shaped and positioned with respect to the auxiliary light source such that the auxiliary light source is within the shadow zone formed by the shadow cap. The auxiliary light source is located below the optical axis by an offset of between 0.25 and 2 times the diameter of the auxiliary light source, e.g. the filament. The spatial distribution of the segments of the reflector is optically associated with the light zone and the shadow zone, respectively, formed by the shadow cap.

In operation, the main light source provides illumination for the depressed beam; for high-beam operation, the auxiliary light source, in addition, is energized.

Basically, thus, the headlight has a reflector defining an optical axis and a two-filament incandescent lamp therein, in which the main filament is partially surrounded by the shadow cap. The main filament is axially located which, in this connection, means that the filament is on the optical axis within quite narrow tolerances.

As well known, the main filament is outside the axis of the lamp bulb, more accurately within the reflector below the axis of the lamp bulb. This prevents glare and blinding or dazzling by mirror images.

The reflector has the two segments of different contour, in which the first segment is optically essentially associated with the main filament, whereas the second segment is optically exclusively illuminated by the auxiliary filament. At least the contour of the first segment is a free-form contour as described in U.S. Pat. No. 4,945,454, Bunse et al., and in U.S. Pat. No. 5,204,820, Strobel et al. The disclosures of these two patents are specifically referred to and incorporated by reference.

Preferably, the second segment of the reflector also is a free-form contour; it is, however, also possible to use a different contour, for example a paraboloid contour.

The contour of the first segment preferably is optimized to provide the requisite brightness—shadow border necessary for the depressed-beam effect. The brightness—shadow border is not formed by the edges of the shadow cap, or by a diaphragm, but rather by suitable superposition of a plurality of images of the main filament providing the depressed-beam light. This is the basic principle. The brightness—darkness border or limit is thus generated by the upper edges of the images of the filament which correspond to the lower edges of the filament. The brightness—shadow limit may, however, also be generated by separate or different elements or structures, for example a diaphragm.

The shadow cap so surrounds the main filament that it shades an azimuth angle of about between 100° and 140°, so that, with respect to the main filament, the reflector will have defined thereon a shadow zone and an illuminated zone. The shadow cap, as well known from the technology in connection with headlights, is so arranged that it is placed, with respect to the reflector, below the main filament. It does not generate the brightness—shadow border, and thus its positioning and dimensioning is less critical than in the case of a shading cap.

The auxiliary filament is located in the reflector below the optical axis. The offset—with respect to the center of the auxiliary filament—is between 0.25 and twice the diameter of the filament, or of the effective light generating zone of another light generating element.

Preferably, the offset is about 0.5, i.e. half the diameter of the filament. The auxiliary filament can be located axially but, in accordance with a particularly preferred embodiment, it is positioned transversely with respect to the optical axis. This permits optimum matching of the radiation characteristics of the auxiliary filament with respect to the two-part contour of the reflector. It is possible to generate exclusively horizontal projections of the filament in the second reflector segment, which can be very effectively transferred into the desired light distribution for high-beam illumination. If the auxiliary filament is axially located, it generates vertically positioned images of the filament in the second reflector segment, which may not provide for optimal light distribution in applications in vehicular headlights.

The distribution of the two segments of the reflector, in space, is roughly matched to the two zones defined by the shadow cap. The first segment, then, will be optically coupled to receive essentially the light from the main filament. This segment is substantially larger than the second segment which is exclusively illuminated by the auxiliary filament. In a top view, both segments are similar to wedge-shaped pie slices, if one assumes a circular opening of the reflector. Together they form a complete pie, corresponding to an azimuth. The second segment is spanned by an azimuth angle which approximately corresponds to the azimuth angle of the shading or shadow cap. Preferably, the azimuth angle of the second segment should be selected to be somewhat smaller than that of the shadow cap itself, due to the partial shade effect; typically, it is smaller by about 10%, but may extend to about 20%.

The shading cap is located essentially beneath the main filament. It is so shaped that the auxiliary filament also is at least primarily within the shaded zone. The basic shape can be rectangular, but it may also roughly correspond to a spoon shape or to a shield shape. If cupped in spoon or shield-shaped manner, the shading cap will have a front tip, which is located between the main filament and the auxiliary filament, two straight or somewhat bent side edges, extending preferably somewhat parallel to the main filament, and one end edge which extends transversely to the side walls or side edges. It may, alternatively, have a blunt end tip. The shading of the auxiliary light source, for example a filament, is effected in general by the forward or front tip of the spoon or shield which, to obtain this effect, can be bent upwardly and/or elongated.

The shading cap can be made from an originally flat, smooth sheet-metal element which is continuously bent into concave form; alternatively, flat sections can be fitted against it, and angled from the flat plate. Such shapes use little material, are easily made, and have few reflexes. The sheet-metal element may, however, also be concavely formed, particularly if it is to have a spoon shape or shield shape.

Considering the main light source, e.g. the filament, to be the origin of a polar coordinate system, the side walls of the shield or spoon-shaped shading element will span an azimuth angle of between about 100° to 140°. In contrast, the shading caps of prior art use an azimuth angle of 165° for asymmetrical low-beam or depressed-beam operation.

The two side walls of the shading cap are clearly below the lower edge of the main filament, with reference to a horizontal plane P (FIG. 2) which includes the main filament and has its origin within the main filament. Preferably, the azimuth distances of the two side walls to this horizontal plane are at an angle $\gamma$ of at least 20°. Preferably, the arrangement of the shading cap is symmetrical to this plane, so that the angular spacing of the two sides to the plane is the same. This is in contrast to the shading caps of the prior art, in which one side is precisely in the horizontal plane, whereas the other side has an azimuth spacing therefrom by about 15°.

In depressed-beam operation, only the main filament together with the first reflector segment is active. There are several variants of respectively preferred embodiments for the high-beam operation.

In a preferred embodiment of one variant, high-beam illumination is obtained by the light radiation from the auxiliary filament which falls in the shaded zone is specifically aimed for reflection at the second segment, and generates an intensive beam, or concentrated bundle of rays to form an essential portion of the high-beam illumination. A portion of the radiation of the auxiliary filament will also fall against the first reflector segment which is not shaded for the auxiliary segment. This radiation, however, does not provide significant stray radiation, but is utilized primarily in high-beam operation, in accordance with this variant, as lateral illumination. The depressed beam, i.e. the main filament, is switched off in this case. In the embodiment of this variant, the electric power rating of the auxiliary filament is about as large as that of the main filament. It can also be somewhat larger, generally by up to about 140% of the main filament. At a typical power rating of the auxiliary filament of 60 W, the overall light emitted is approximately 200 lm.

In a preferred embodiment of a second variant, the high-beam illumination is obtained by superimposing the previously referred-to bundle of light rays, as well as the radiation which illuminates the sides, which are both generated by the high-beam auxiliary filament to the then concurrently used and operated low-beam illumination from the main filament. In other words, for high-beam illumination, both the low-beam and the high-beam filaments, or other light sources, are used simultaneously. When this variant is selected, it is sufficient if the auxiliary filament has a lower power rating than the main filament, e.g. only between 20% and 80% of the power rating of the main filament. This arrangement illustrates the high efficacy of the headlight system.

The lamp itself preferably is a halogen incandescent lamp, since the dimensions thereof are very small, and such lamps have a long lifetime.

The distribution of the reflector surfaces to the two segments can use, for example, a proportion in which the surface proportion of the second segment, which is associated with the shadow zone, has about between 10% to 30% of the overall surface of the reflector. This is merely a point of reference for the design of the distribution of the reflector surfaces. If the auxiliary filament has a power rating of between about 20 W and 40 W, the effective light radiation received from the second segment, preferably, will then be about 80 Lm. A typical rating for the main filament is 50 W to 70 W.

In accordance with a particularly preferred embodiment, the electrical terminals of the two filaments are so connected that the main filament forms the depressed beam whereas, for high-beam illumination, both the main filament and the auxiliary filament are simultaneously emitting light, the high beam being formed as superposition of the radiation from the two filaments.

The scope of the present invention is not restricted to automotive headlights, although specifically suitable therefor. It may also be used for other applications, for example for applications forming the Eureka Project 1403, and known as Advanced Frontlighting System (AFS). The light distribution is characterized in that it is matched better to different traffic situations, and more flexibly meets requirements, by use of improved technology than the light distribution for high-beam and low-beam illumination only, set by fixed standards. One example is associating the brightness—darkness border with vehicle speed.

In accordance with a feature of the invention, the individual filaments may also be operated separately, as is customary in the prior art but, in accordance with a feature of the invention, can be additionally connected to operate together. When such switching is possible, three or more operating modes can be obtained. The light distribution in accordance with the prior art only provides for "high-beam" and "low-beam" or depressed-beam operation. Not only are these two light distributions available, but additional and new light distribution patterns can be obtained which are suitable for modern traffic, such as "city light", "general highway illumination", "multi-lane (thruway or freeway) illumination", "road sign illumination", and the like. Such operating modes are described, for example, in German Patent Publication 41 24 374, Peitz.

The technology described herein has the specific advantage that a plurality of different functions can be offered in a modern illumination system, and yet keep the number of the required headlight units at a minimum.

The Advanced Frontlighting System (AFS) may use additional auxiliary devices, known as such, such as shiftable diaphragms and movable mirrors. Brightness—darkness borders can also be obtained by diaphragms. In such applications, the auxiliary filament is preferably axially located. This can be particularly advantageous when the associated reflector is very shallow or, for example, formed in rectangular shape.

The lamps themselves, as well as the headlight system, are suitable not only for vehicular headlights, but also for use with any reflector system, particularly for search lights or spot lights utilizing reflector systems which, at least in part and preferably entirely, are of the free-form surface reflector type. The lamp, preferably a halogen incandescent lamp, should have the characteristics of a cylindrical or similar bulb which defines a bulb axis, and a base which defines a reference axis. The reference axis corresponds to the optical axis of the reflector system. The main filament is located in the reference axis and surrounded by a metallic shading cap to form a shading element and to shade an azimuth angle of between about 100° and 140°. The lamp additionally has an auxiliary light source or filament which is located outside of the reference axis, preferably spaced from the reference axis between about 0.25 and 2 times the diameter of the auxiliary light source, typically the auxiliary filament. The shading cap is so shaped that the auxiliary filament, at least primarily and preferably entirely, is within the shaded zone.

Preferably, the two filaments are so designed that their power ratings are about equally large or they are so designed that the power rating of the auxiliary filament is between 20% and 80%, and preferably about 50%, of the power rating of the main filament.

For the standard operation modes, "high-beam" and "low-beam" or depressed-beam illumination, a lamp in which the auxiliary filament is located transversely with respect to the main filament is particularly suitable. Such a lamp permits defining a horizontal plane which includes the main filament and which extends parallel to the auxiliary filament, and which has its origin within the main filament. With reference to this horizontal plane, both side walls of the shading cap are located clearly below the lower edge of the main filament, and preferably both side walls have an angular spacing to this horizontal plane by at least 20°.

If more than the two standard light distributions, "high-beam" and "low-beam", are to be used, that is, if the lamp is to form part of an AFS, it may be desirable to position the auxiliary filament axially with respect to the main filament. In such an arrangement, a horizontal plane may be defined which includes the main filament and has its origin in the main filament, and which, additionally, is perpendicular to a plane which includes both filaments. It is preferred if, with reference to this horizontal plane, both side edges of the shading cap are clearly below the lower edge of the main filament; preferably, the side edges have an angular space of at least 20° from this horizontal plane.

For special requirements, it is also possible to locate the auxiliary filament at an inclination with respect to the main filament, and to the optical axis.

It is possible to so position the auxiliary filament that it does not completely fall within the shadow zone of the shading cap—in dependence on the alignment of the auxiliary filament with respect to the main filament. This is particularly so if the auxiliary filament is transversely located or at an inclination with respect to the main filament. In general, at least 80%, and preferably more than 95%, of the illuminating, bright surface of the auxiliary filament should be within the shaded zone. In case of a transverse auxiliary filament, a compromise between a short filament, preferred for good shading, and a somewhat longer filament, preferred for good light distribution under "high-beam" conditions must be made.

DRAWINGS

FIG. 1 is a highly schematic longitudinal partial cross section through a vehicular headlight with a two-filament light bulb, in which the auxiliary filament is located transversely to the main filament;

FIG. 2*a* is a side view, to an enlarged scale, of a portion of the headlight of FIG. 1;

FIG. 2*b* is a cross section through the headlight of FIG. 1;

FIG. 2*c* is a simplified end view;

FIGS. 3*a*–3*d* are diagrams of light distribution in dependence on illumination by respective filaments of the headlight of FIG. 1;

FIG. 4*a* is a side view similar to FIG. 2*a* of another embodiment in which the auxiliary filament is axially behind the main filament;

FIG. 4*b* is an enlarged end view of the headlight with the filament distribution of FIG. 4*a;*

FIGS. 5*a*–5*d* are diagrams of light distribution obtained from a headlight in accordance with FIG. 4, and with different energization of the filaments;

FIG. 6*a* illustrates another arrangement of filaments and the shading cap of the headlight of FIG. 1; and FIG. 6*b* is an end view of the headlight using the arrangement of FIG. 6*a*.

DETAILED DESCRIPTION

Figure 1:
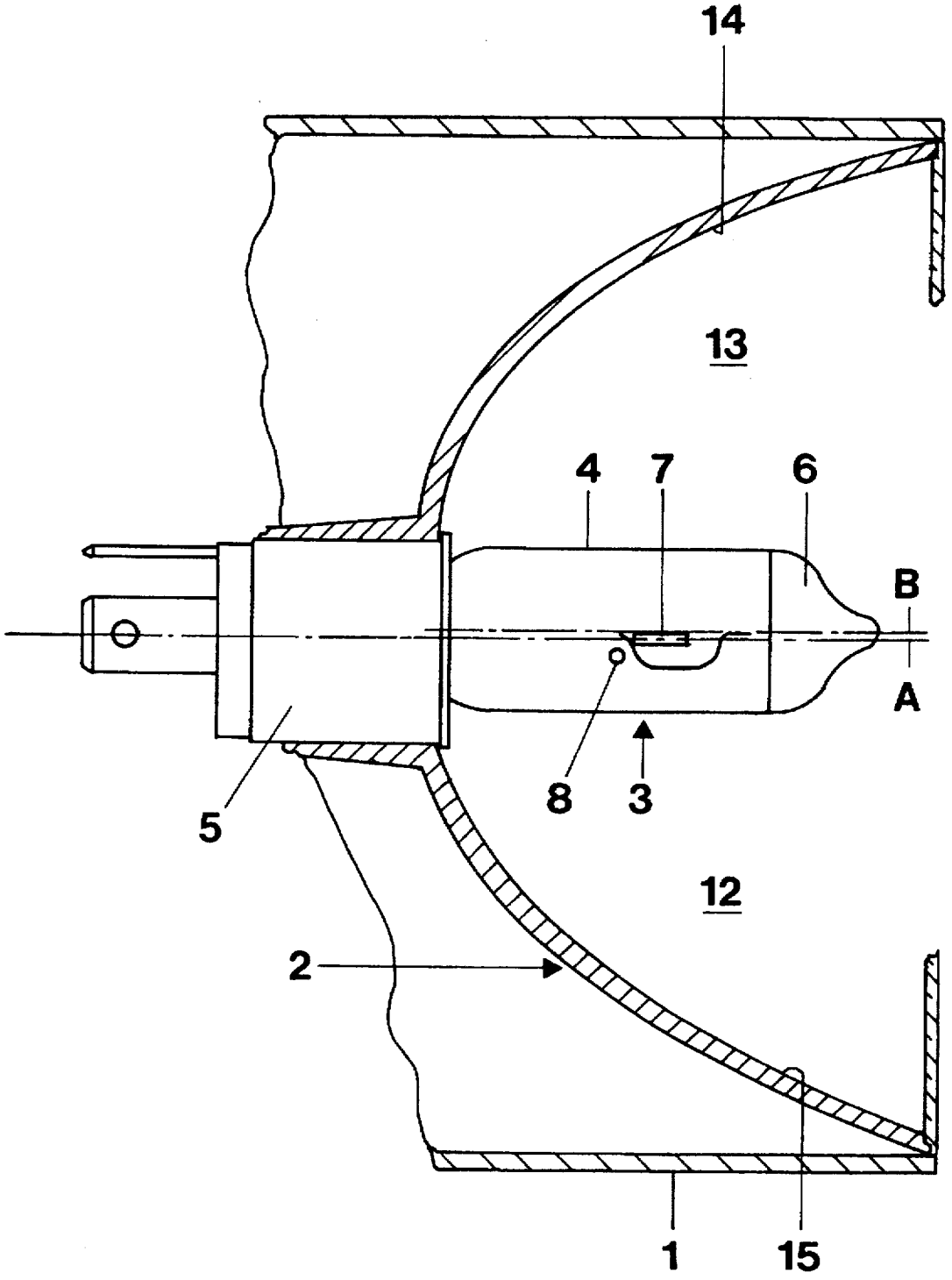

FIG. 1 is a highly schematic representation of a headlight 1 having a reflector 2 to reflect light emitted from a light emitting element shown as a halogen incandescent lamp 3. The reflector defines an optical axis A. The lamp 3 has a cylindrical bulb 4. The bulb 4 has an axis B which is parallel to the optical axis A of the reflector. The bulb 4 is a single-ended pinch-sealed bulb. The bulb 4 is secured in a base 5. The end of the bulb 4 remote from the base 5 is rounded and coated with a light absorption coating 6. The lamp 3 has two filaments. A main filament 7 with a power rating of 50 W is positioned in a reference axis of the base 5 which is congruent with the optical axis A of the reflector. The optical axis A is slightly below the bulb axis B which, of course, extends parallel to the optical, or base reference axis A.

The bulb 3 retains a second, auxiliary filament 8, having a power rating of 25 W. Filament 8 is located transversely to the optical axis A. The auxiliary filament is located between the base 5 and the main filament 7, just below the optical axis A. The auxiliary filament 8 has a diameter of about 1.35 mm. The spacing of the auxiliary filament 8 from the main filament 7 is about 2 mm; the spacing of the center of the coil filament 8 to the optical axis is about 1 mm. The offset of the auxiliary filament 8 to the optical axis A is about 0.75 times the diameter of the auxiliary filament 8.

Figure 2A:
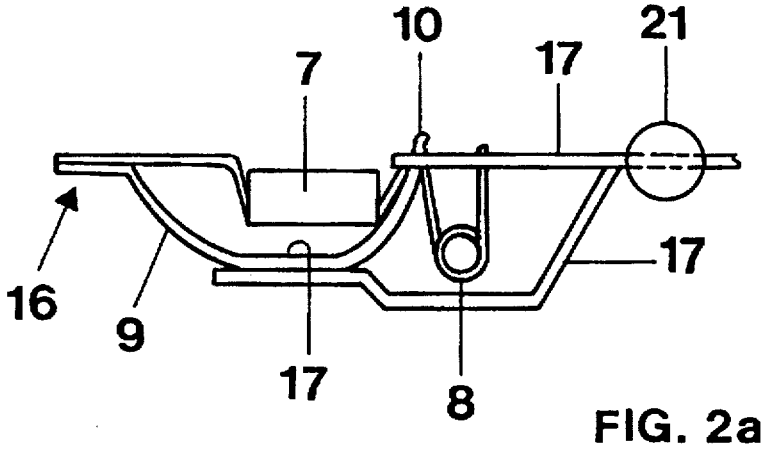
Figure 2B:
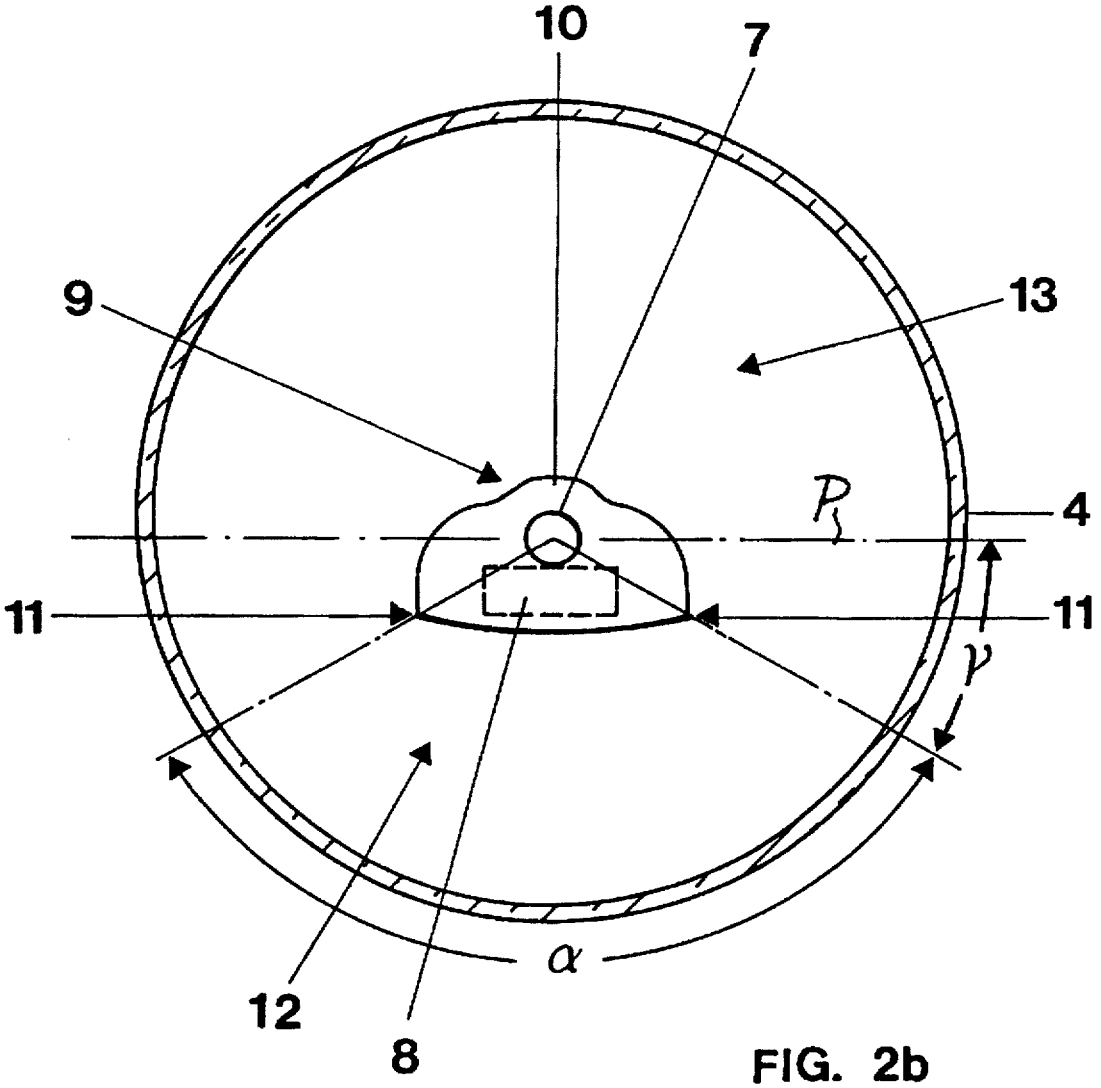

The geometric relationships of the various components of the lamp within the bulb are best seen with reference to FIG. 2 (collectively), in which FIGS. 2*a* and 2*b* show these geometric relationships in a highly enlarged representation, both in side view and cross section. The filaments 7 and 8 as well as a shadow or shading cap 9 are connected to current supply leads 17 in customary manner. The current supply leads 17 are secured in a cross beam or cross rib 21 of quartz glass. The shadow cap 9 is located horizontally beneath the main filament 7. The shadow cap 9 is a sheet-metal element which is concavely bent, to be shield-like and form a blunt end tip 10. It has two side walls 11, and an end edge 16. The tip 10 of the shading cap 9 is located between the main filament 7 and the auxiliary filament 8. It is drawn upwardly to such an extent that, looked at from the main filament 7, it practically completely shades the auxiliary filament 8. The spacing of the shading cap 9 from the main filament 7, as well as its width, that is the spacing between the side edges 11, is so dimensioned that, looked at from the main filament 7, a shadow zone 12 (FIG. 2*b*) will be formed which extends over an azimuth angle $\alpha$ of about 120°. Correspondingly, the illuminated zone 13 will be formed by the remaining azimuth angle of 240°. The shading cap 9 is located symmetrically with respect to a vertical axis. Asymmetrical light distribution is nevertheless obtained by the shape of the reflector contour.

Surprisingly, the shadow cap is possible to so arrange the filaments, the filament cap, and their relationship to the reflector with respect to each other that the width of the transverse auxiliary filament 8 can be selected to be less than the width of the shading cap 9 while, simultaneously, the space of the side edges of the shading cap 9 from the main filament 7 can be so selected that the azimuth angle $\alpha$, looked at from the main filament 7, will provide the required shading of about 120°.

Figure 2C:
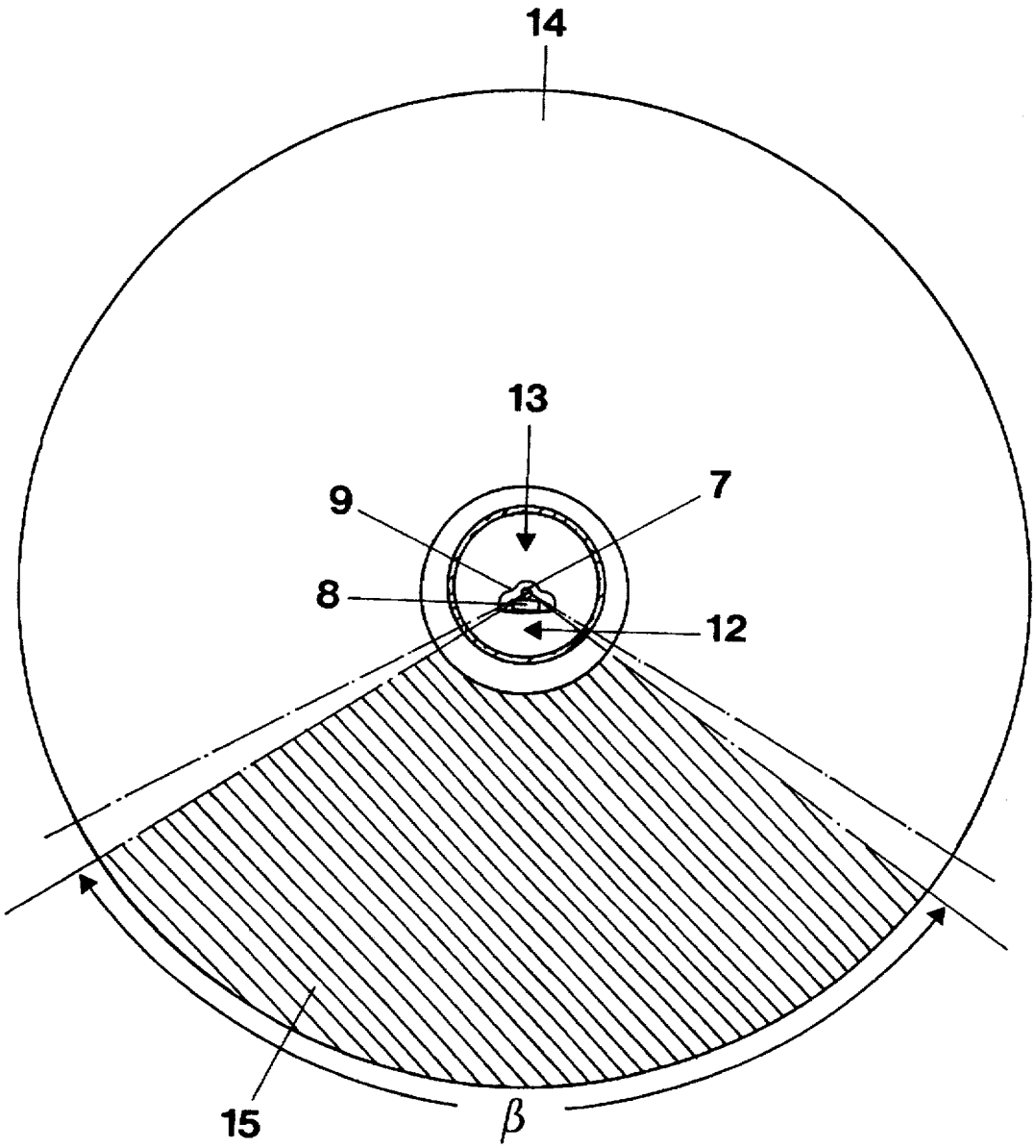

The reflector contour is shown highly schematically in FIGS. 1 and 2*c*. It is formed by two segments 14, 15, which are both constructed as free-formed surface reflectors. The segment 15 is shown hatched in FIG. 2 (collectively) merely for contrast with the segment 14. Light from the main filament 7 is primarily reflected by the first segment 14 which is the upper part of the headlight. The second segment 15, shown cross-hatched for contrast, is below the first segment 14 and specifically and exclusively reflects the light from the auxiliary filament 8.

The auxiliary filament 8 is so located within the headlight that it is just below the focal volume of the second reflector segment 15. If the second reflector segment 15 is a paraboloid, the auxiliary filament 8 is located just below the focal point thereof. In the top view of FIG. 2*c*, the two segments 14 and 15 approximately cover each other in the light and shadow zones 13, 12 formed by the shading cap 9. The azimuth angle $\beta$ of the second segment covers about 110°; that of the first segment the remaining angle of 250° to complete the overall azimuth angle of 360°.

Figure 6A:
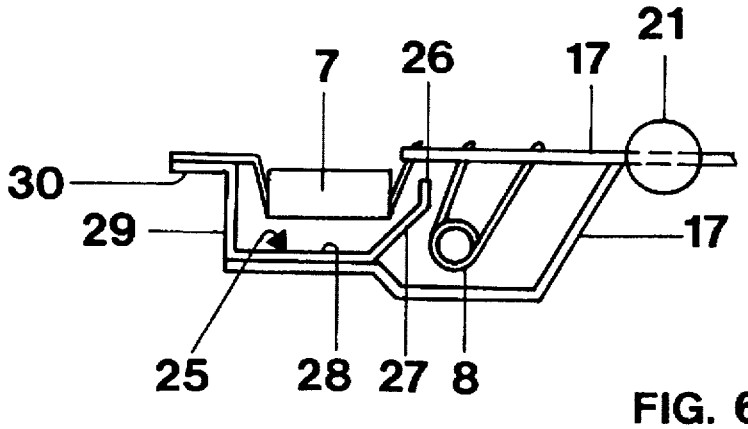
Figure 6B:
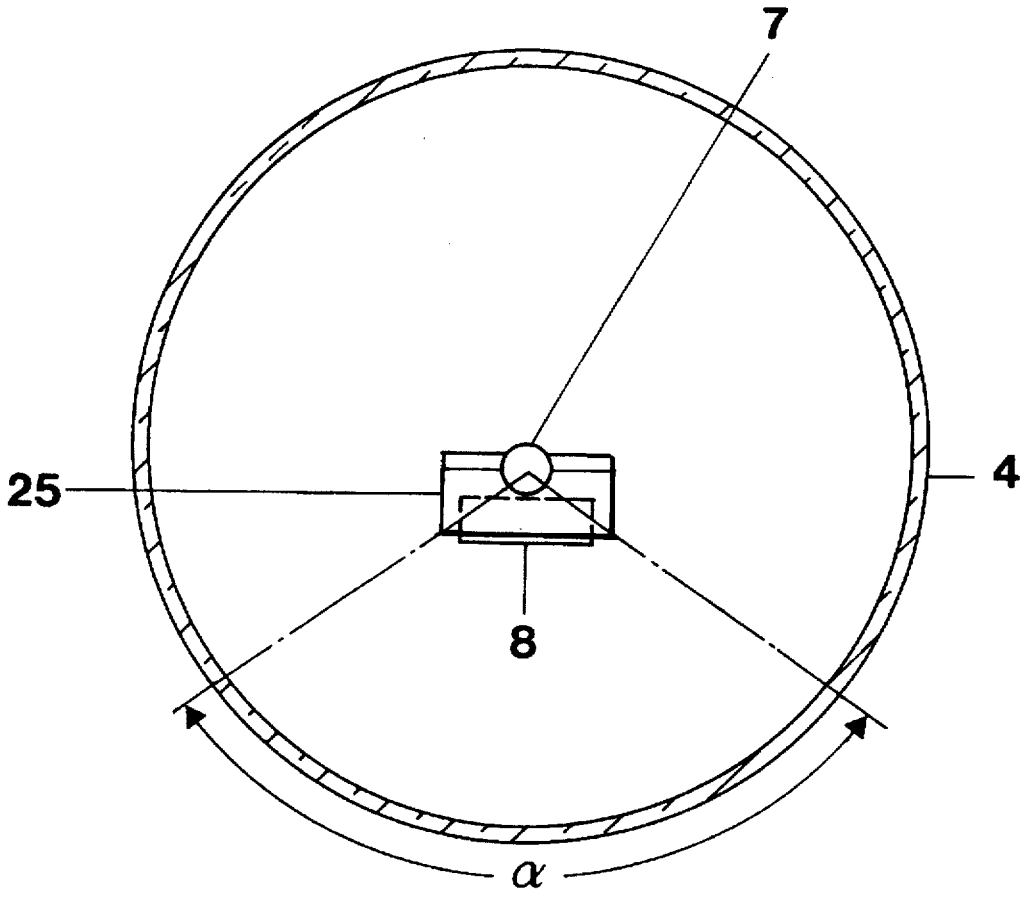

FIG. 6*a* illustrates an embodiment of a halogen incandescent lamp with a transverse auxiliary filament 8, in which the shading cap 25 is of somewhat different construction. It is formed of a plurality of portions 26, 27, 28, 30, which adjoin each other and are angled off a plane flat sheet of metal. Such a shading cap has few reflexes and can be easily made from a rectangular strip of sheet metal with minimum scrap or waste. The azimuth angle $\alpha$ (FIG. 6*b*) is 110°.

In another embodiment, the headlight may have a generally rectangular basic shape, for example a width of about 13 cm and a height of about 10 cm.

Measuring of the light distribution, FIGS. 3 and 5, collectively, is done on a measuring wall or measuring screen located 25 meters from the light source. The horizontal angle covered extends from −30° to +30°; the vertical angle is between −5° and +5°.

When the headlight is to be operated in depressed-beam mode, only the main filament 7 is energized. Consequently, only the first segment 14 (FIG. 2c) of the reflector is illuminated. The free-form surface portion of this segment of the reflector generates the typical asymmetrical depressed-beam illumination distribution, as schematically shown in FIG. 3a.

Figure 3A:
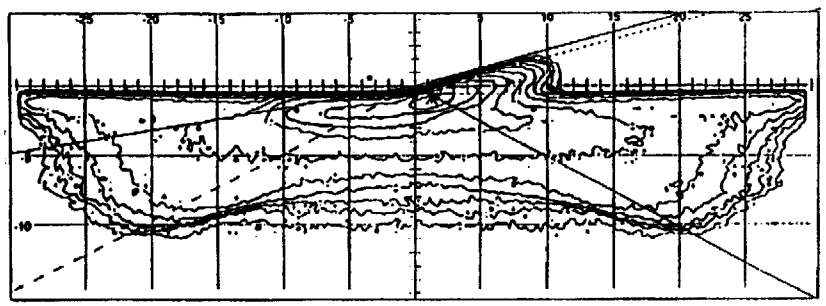

Illumination from the depressed-beam filament 7, FIG. 3a, is obtained without additional auxiliary devices, such as a depressed-beam shading cap or mask. FIG. 3a shows lines of equal brightness. The sharp brightness—darkness border or limit is clearly apparent.

For highway or high-beam illumination, in one embodiment of the invention, the auxiliary filament 8 is energized in addition to energization of the main filament 7. Consequently, the high-beam light distribution is a composite of various components:

(a) A first component, as obtained by the depressed-beam light distribution in accordance with FIG. 3a, derived from the main filament 7, in combination with the first reflector segment 14.

(b) A second component, essential for high-beam operation, is formed by a narrow bright light bundle or beam in the center of the light distribution. This component is obtained by the auxiliary filament 8 in combination with the second reflector segment 15. This component, alone, is shown in FIG. 3b.

Figure 3C:
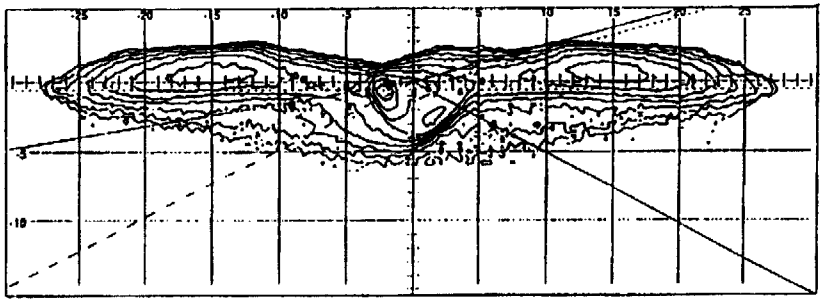

(c) A third component is obtained from the auxiliary filament 8 by illumination of the first reflector segment 14. This results in an additional illumination of lateral regions, as seen in FIG. 3c. This additional light, together with the depressed-beam light, is used to remove the "tunnel effect" due to the bundled light or beam from the second reflector segment (component b).

Figure 3B:
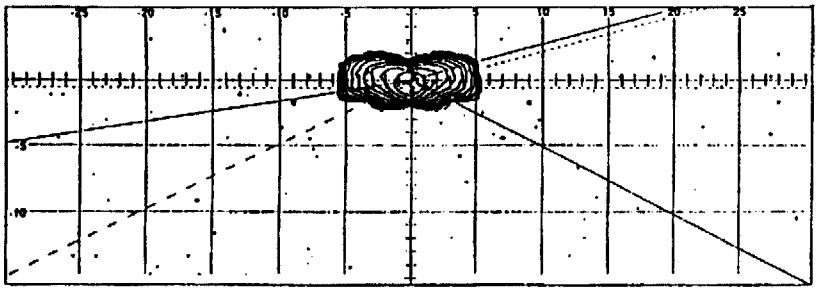
Figure 3D:
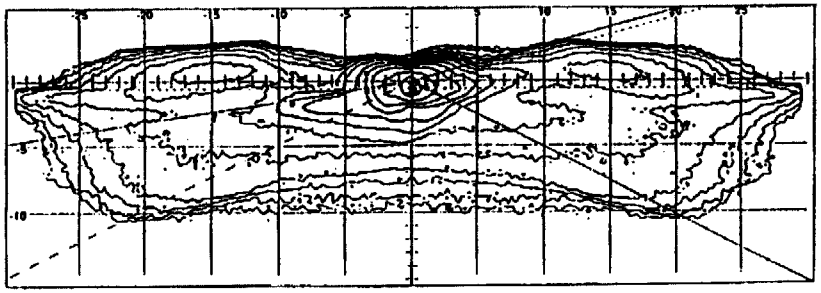

The resulting composite, superimposed overall illumination obtained is shown in FIG. 3d, namely the sum of the three separate components illustrated in FIGS. 3a, 3b, 3c. It should be noted that the overall high-beam light distribution is highly uniform and appropriate, gradually merging into the bright beam in the center. The high efficacy of the overall light being emitted likewise is apparent.

Figure 4A:
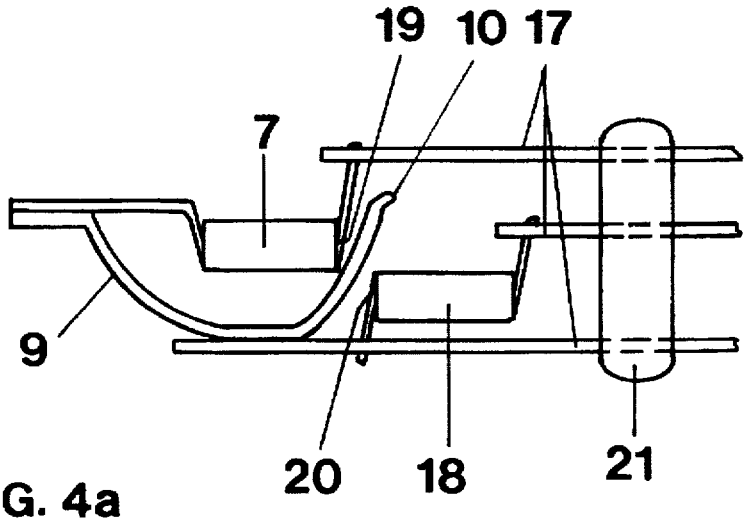
Figure 4B:
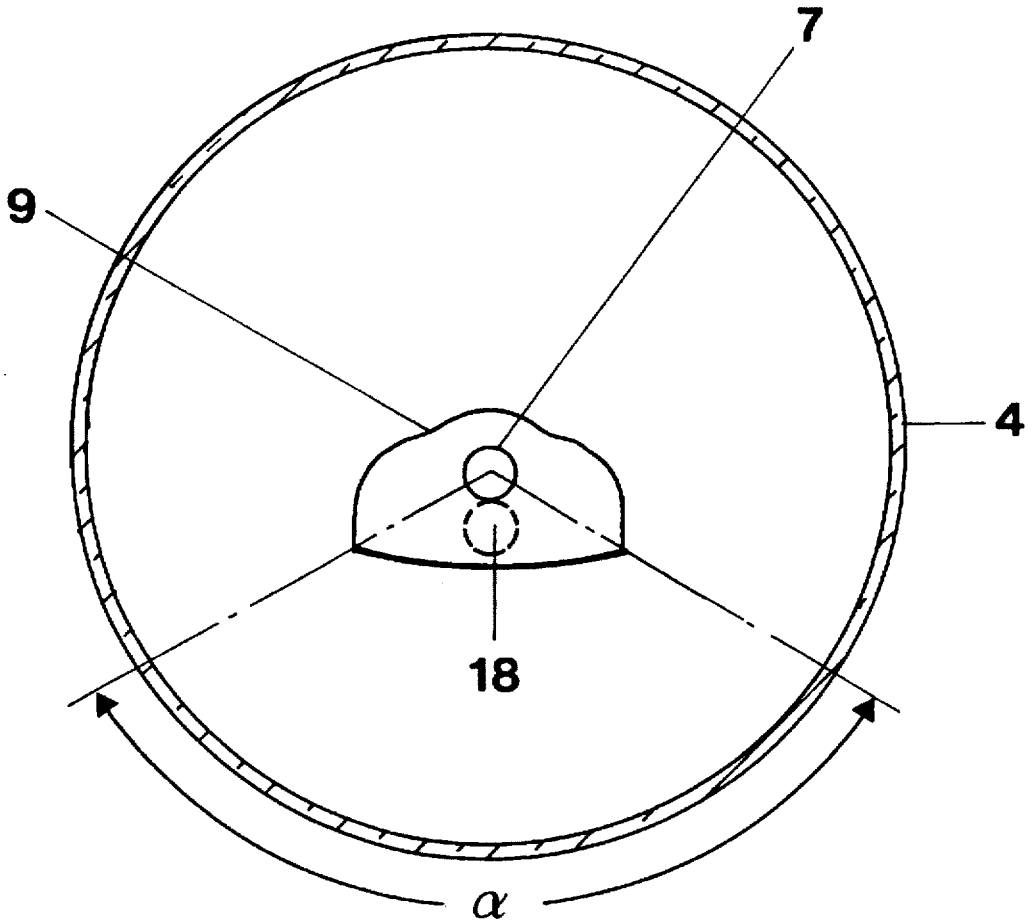

In the embodiment illustrated in FIGS. 4a and 4b, the auxiliary filament 18 is axially located behind the main filament 7 and therebelow. Other than the relocation of the filament 18, the same general structural components as used in FIG. 1 are also employed. The auxiliary filament 18 is placed about 1 mm below the optical axis A of the reflector. The spacing between the adjacent edges 19 and 20 of the main filament 7, and the auxiliary filament 18, respectively, is 1.5 mm. The shading cap 9 is located similar to the embodiment of FIGS. 1 and 2.

The light distribution of the lamp in accordance with FIGS. 4a and 4b, is illustrated in FIGS. 5a–5d. The filaments are energized in the same way as described in connection with the light patterns of FIG. 3a–3d.

The overall light obtained will, again, be a combination of light components:

(a) The light distribution of the depressed beam (see FIG. 5a) is generated by the main filament 7 in combination with the first reflector segment 14. This light distribution is essentially identical to that of FIG. 3a.

Figure 5C:
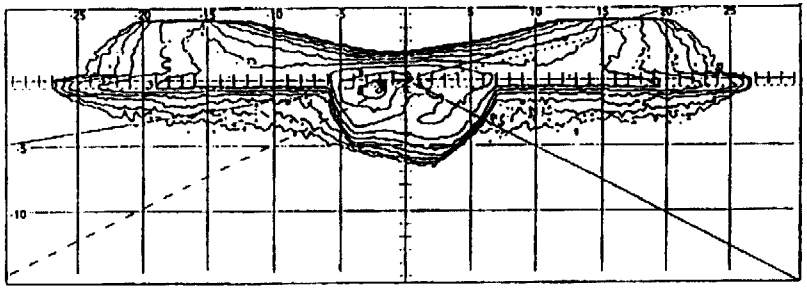
Figure 5D:
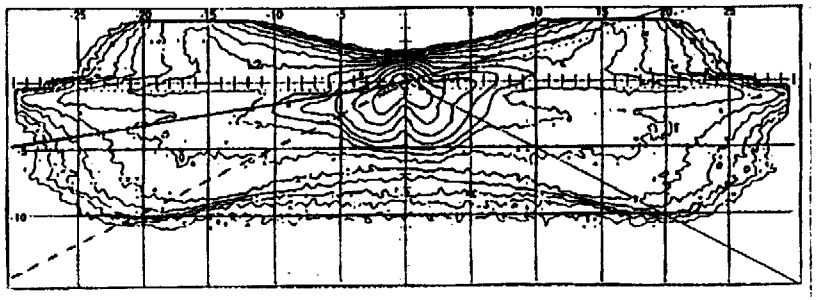
Figure 5A:
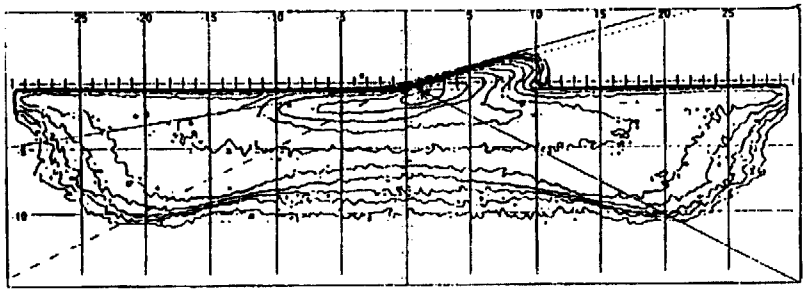
Figure 5B:
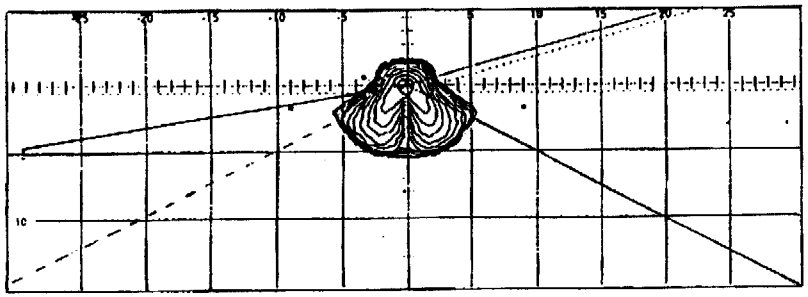

(b) The auxiliary filament 18, in optical cooperation or association with the second segment 15 of the reflector, however, provides a different light distribution from that of FIG. 3b, that is, a beam of light which has a comparatively large near-field illumination, see FIG. 5b.

(c) Lateral light distribution (see FIG. 5c) obtained from auxiliary filament 18 and illumination of first reflector segment 14 is less homogeneous than in the embodiment illustrated in diagram 3c, and not as wide.

The composite high-beam illumination, see FIG. 5d, that is, the addition of components of FIGS. 5a, 5b and 5c, is still better than that of a prior art H4 lamp-equipped headlight. The maximum illumination and brightness obtained, however, is somewhat less than in the example of the filament placement as illustrated in FIGS. 1 and 2.

Basically, both types of lamps (FIG. 1 and FIG. 4, collectively) can be used with reflector systems which are different from systems having two segments. Both segments of the reflector of an automotive headlight have, for example, free-formed surface contours which permit the following light distribution:

(k) Separate energization of the main filament provides for a light distribution via the first reflector system which is suitable for an operating mode for city or depressed-beam driving. A shiftable system of diaphragms, located in the level of the horizontal plane, can form a beam depressing arrangement where the beam is substantially depressed.

(l) Using (k) above, and shifting the diaphragm system out of the optical rays, that is, out of the optical path, while only energizing the main filament 7, results in a light distribution which is suitable for depressed-beam highway driving.

(m) Energizing auxiliary filament 18, located transversely to the optical axis, as in FIG. 1 and FIG. 2 (collectively) and filament 7 together, provides for a light distribution suitable for illumination for multi-lane highway driving, such as throughway or freeway.

(n) As an alternative, and with suitably optimized reflector contour, while operating the main filament 7 and the auxiliary filament 18 together, a light distribution for the operating mode "roadsign illumination" can be obtained by slightly tipping the reflector.

In a further embodiment, according to the invention, and with reference, for example, to the explanations in connection with FIG. 3, collectively:

In depressed-beam operation, again, only the main filament 7 is energized and, accordingly, only the first segment 14 of the reflector is illuminated. The above explanations and FIGS. 3a, 5a apply.

In high-beam illumination in accordance with this variant or embodiment, only the auxiliary filament 8 or 18 is energized, so that the high-beam light distribution is composed of two components only:

(a) A first component essential for the high beam comprises a first bright light bundle or beam in the center of the light distribution. This is generated by the auxiliary filament 8 in combination with the second reflector segment 15. This component again resembles the light distribution shown in FIG. 3b; it is, however, not as narrow. The contour of the reflector segment 15 can be suitably modified, if required.

(b) Added to this is a second component which results from the fact that the auxiliary filament 8 also illuminates the first reflector segment 14. In this way, an additional illumination of the lateral regions according to FIG. 3c is reached, in order to eliminate again the "tunnel effect" generated by the light bundle derived from the second segment 15 of the reflector.

The resulting high beam resembles the light distribution illustrated in FIG. 3d. It is the sum of these two separate components.

Various changes and modifications may be made, and any features described herein with respect to any one of the variants or embodiments may be used with any of the others, within the scope of the inventive concept.

We claim:

1. A vehicular headlight (1) providing both depressed-beam and high-beam illumination, having a lamp (3) including a bulb (4) and two light emitting elements (7, 8; 18) within the bulb, wherein a first (7) of said light emitting elements defines a main light source (7) and is axially located within the bulb, and a second one (8, 18) of said light emitting elements defines an auxiliary light source (8; 18);

a shadow cap (9, 25) partly surrounding the main light source (7); and a reflector (2) defining an optical axis (A), and having two segments (14, 15), the lamp being mounted within the reflector, wherein, in accordance with the invention, the segments (14, 15) of the reflector have different contours;

a first one (14) of said reflector segments being optically associated with the main light source (7);

at least the contour of the first one (14) of the segments has a free-formed surface reflection contour;

a second one (15) of said reflector segments is optically associated with the auxiliary light source (8, 18);

the shadow cap (9, 25) has a shadow angle of between 100° and 140° with respect to the light emitted from said main light source (7), thereby forming a shadow zone (12) and a light zone (13) within the reflector, said shadow cap (9, 25) being shaped and positioned with respect to the auxiliary light source (8, 18) such that the auxiliary light source is within the shadow zone (12) formed by the shadow cap (9, 25);

the auxiliary light source is located below the optical axis (A) by an offset of between 0.25 and 2 times the diameter of the auxiliary light source (8); and wherein the spatial distribution of the segments (14, 15) of the reflector (2) is optically associated with said light zone (13) and said shadow zone (12), respectively, formed by said shadow cap (9, 25).

2. The headlight of claim 1, wherein the free-formed surface reflector contour of the first segment (14) of the reflector is designed and arranged to provide a brightness—darkness boundary required for depressed-beam illumination.

3. The headlight of claim 2, wherein the headlight defines a horizontal plane (P) in which the main light source (7) is located, and forms the origin of the plane;

and wherein the shadow cap (9, 25) defines two lateral edge walls (11), and said edge walls are located markedly below the lower edge of the main light source and, optionally, the two side edges have a spacing by an angle (γ) of at least 20° from said horizontal plane (P).

4. The headlight of claim 1, wherein the second segment (15) of the reflector (2) has at least one of: a paraboloid contour, and a free-formed surface reflector contour.

5. The headlight of claim 4, wherein the radiation of the auxiliary light source (8) which extends within the shadow zone (12) formed by the shadow cap (9, 25) forms, with said first segment (14), laterally spread illumination, and also forms, with said second segment (15), a narrow, intensive beam or bundle of light rays to generate essential portions of high-beam illumination derived from said headlight.

6. The headlight of claim 1, wherein the auxiliary light source (8) is located to extend transversely to the optical axis (A).

7. The headlight of claim 1, wherein the power rating of the auxiliary light source (8, 18) is between 20% and 80% of the power rating of the main light source (7).

8. The headlight of claim 1, wherein said lamp (3) comprises a halogen incandescent lamp, and said light emitting elements (7, 8, 18) are filaments within the halogen incandescent lamp.

9. The headlight of claim 1, wherein said second segment (15) of the reflector (2), and optically associated with the shadow zone (12) formed by the shadow cap (9, 25), comprises approximately between 10% and 30% of the overall surface of the reflector.

10. The headlight of claim 1, wherein said light emitting elements (7, 8, 18) defining said main light source (7) and said auxiliary light source (8, 18) are electrically connected such that, for depressed-beam illumination, only the first or main light emitting element is energized while, for high-beam illumination, both the main (7) and the auxiliary (8, 18) light emitting elements are energized whereby, for high-beam illumination, the light radiation as reflected by said reflector segments (14, 15) emitted from the main light emitting element (7) and from the auxiliary light emitting element (8, 18) are superimposed.

11. The headlight of claim 1, wherein said light emitting elements (7, 8, 18) defining said main light source (7) and said auxiliary light source (8, 18) are electrically connected such that, for depressed-beam illumination, only the first or main light emitting element (7) is energized while, for high-beam illumination, only the auxiliary light emitting element (8, 18) is energized, whereby, for high-beam illumination, the light radiation as reflected by the second one (15) of said reflector segments and the light radiation illuminating the first reflector segment (14), and reflected thereby, will be superimposed to provide additional illumination of lateral regions of an illuminated field and eliminate the tunnel effect generated by reflection of light from said second segment (15) of said reflector (2).

12. The headlight of claim 11, wherein the power rating of the auxiliary light source (8, 18) is up to about 140% of the power rating of the main light source (7).

13. A halogen incandescent lamp, for combination with a reflector system, optionally a vehicular headlight, wherein the reflector system at least in part defines a free-form surface reflector contour, said halogen incandescent lamp comprising a bulb (4) defining a bulb axis;

a base (5) defining a reference axis which coincides with the optical axis (A) of the reflector system with which the halogen incandescent lamp is intended to be associated;

a main filament (7) located in the reference axis (A);

a metallic shadow cap (9, 25) in part surrounding said main filament (7), shading light radiation from said main filament within an azimuth angle of between about 100° and 140° and defining a shadow zone (12);

an auxiliary filament (8, 18) located spaced from said reference axis (A) by a distance which is between about 0.25 and 2 times the diameter of the auxiliary filament (8, 18); and wherein said shading cap (9, 25) is dimensioned and shaped, and the position thereof with respect to the auxiliary filament is so located that the radiation from the auxiliary filament is at least primarily within the shadow zone (12) of the shading cap (9, 25) shading said main filament (7).

14. The lamp of claim 13, wherein the power rating of the auxiliary filament (8, 18) is, selectively, between approximately 20% and 80%, or between approximately 100% and 140% of the power rating of the main filament (7).

15. The lamp of claim 13, wherein the auxiliary filament (8) is positioned transversely with respect to the longitudinal extent of the main filament (7).

16. The lamp of claim 15, wherein said lamp defines a horizontal plane (P), which includes the main filament (7), extends parallel to the auxiliary filament (8, 18) and has its origin in the main filament (7); and both side walls (11) of the shading cap (9, 25) are located markedly below said plane (P), and below the lowest extent of the main filament (7), said side walls (11) optionally being located at both sides at an angle (γ) of at least 20° with respect to said horizontal plane (P).

17. The lamp of claim 13, wherein the auxiliary filament (18) is located axially with respect to the longitudinal extent of the main filament (7).

18. The lamp of claim 17, wherein said lamp defines a horizontal plane (P), which includes the main filament (7), extends parallel to the auxiliary filament (8, 18) and has its origin in the main filament (7); and both side walls (11) of the shading cap (9, 25) are located markedly below said plane (P), and below the lowest extent of the main filament (7), said side walls (11) optionally being located at both sides at an angle (γ) of at least 20° with respect to said horizontal plane (P).

19. The lamp of claim 13, wherein the shading cap (25) is a smooth sheet-metal element which is continuously bent, and bowed into cup shape, or formed of angled, essentially flat surfaces to form a cup-shaped element.

20. The lamp of claim 13, in combination with said reflector, wherein said reflector comprises two segments (14, 15) of different contours, a first one (14) of said contours being optically associated with said main filament (7), and wherein the contour of said first one (14) of the segments has a free-formed surface reflector contour;

wherein the second one (15) of said reflector contours is optically associated with the auxiliary filament (8, 18); and wherein the spatial distribution of said segments of the reflector (2) is arranged for optical association of a first one (14) of said segments with a light zone (13) derived from radiation of said main light source (7), and a second one of said segments (15) with the shadow zone (12) due to said shadow cap (9, 25) upon energization of said main filament (7).

* * * * *